US007056091B2

(12) United States Patent
Powers

(10) Patent No.: US 7,056,091 B2
(45) Date of Patent: Jun. 6, 2006

(54) PROPELLER HUB ASSEMBLY HAVING OVERLAP ZONE WITH OPTIONAL REMOVABLE EXHAUST RING AND SIZED VENTILATION PLUGS

(76) Inventor: Charles S. Powers, 575 Unadilla St., Shreveport, LA (US) 71105

( * ) Notice: Subject to any disclaimer, the term of this patent is extended or adjusted under 35 U.S.C. 154(b) by 0 days.

(21) Appl. No.: 10/818,968

(22) Filed: Apr. 6, 2004

(65) Prior Publication Data

US 2005/0191180 A1 Sep. 1, 2005

Related U.S. Application Data

(60) Provisional application No. 60/461,103, filed on Apr. 9, 2003.

(51) Int. Cl.
*B63H 1/28* (2006.01)

(52) U.S. Cl. ..... 416/93 A; 416/245 A; 440/89 R

(58) Field of Classification Search ..... 416/93 A, 416/244 B, 245 A, 134 R, 135; 440/89 A, 440/89 R See application file for complete search history.

(56) References Cited

U.S. PATENT DOCUMENTS

| | | | | |
|---|---|---|---|---|
| 3,754,837 | A | 8/1973 | Shimanckas | 416/93 |
| 3,788,267 | A | 1/1974 | Strong | 115/17 |
| 4,276,036 | A | 6/1981 | Nishida et al. | 440/89 |
| 4,436,514 | A | 3/1984 | Takahashi et al. | 440/89 |
| 4,545,771 | A | 10/1985 | Iio | 440/89 |
| 4,802,872 | A | 2/1989 | Stanton | 440/89 |
| 4,930,987 | A | 6/1990 | Stahl | 416/93 A |
| 4,931,026 | A | 6/1990 | Woodland | 440/38 |
| 4,965,953 | A | 10/1990 | McKinney | 43/2 |
| 5,325,662 | A | 7/1994 | Varney et al. | 60/221 |
| 5,352,141 | A | 10/1994 | Shields et al. | 440/80 |
| 5,421,756 | A | 6/1995 | Hayasaka | 440/89 |
| 5,423,701 | A | 6/1995 | Rodskier et al. | 440/81 |
| 5,464,321 | A | 11/1995 | Williams et al. | 416/93 A |
| 5,549,455 | A | 8/1996 | Speer | 416/93 A |
| 5,916,003 | A * | 6/1999 | Masini et al. | 440/89 R |
| 6,010,380 | A | 1/2000 | Wollard | 440/89 |
| 6,375,528 | B1 * | 4/2002 | Neisen | 440/89 R |

* cited by examiner

*Primary Examiner*—Edward K. Look
*Assistant Examiner*—Nathan Wiehe

(57) ABSTRACT

A propeller hub assembly having a through-hub exhaust propeller hub characterized by an interior overlap zone defined by the composite interior dimensions of a selected number of conventional propeller hubs and optionally fitted with a removable exhaust ring and/or sized ventilation plugs. The hub assembly of this invention includes specially designed driver adaptors for insertion in the overlap zone of a universal propeller hub and accommodating corresponding conventional OEM factory thrust washers normally used in the conventional propeller hubs. The overlap zone design facilitates installation of the propeller hub assembly on any conventional lower unit outdrive utilizing the OEM factory thrust washers and corresponding driver adaptors. The exhaust ring and sized ventilation plugs facilitate optimum engine exhaust porting through the hub assembly for various applications, such as racing and other high performance operation.

25 Claims, 10 Drawing Sheets

PROPELLER HUB ASSEMBLY HAVING OVERLAP ZONE WITH OPTIONAL REMOVABLE EXHAUST RING AND SIZED VENTILATION PLUGS

CROSS-REFERENCE TO RELATED APPLICATIONS

This application claims the benefit of and incorporates by reference prior filed now abandoned U.S. Provisional Patent Application Ser. No. 60/461,103, filed Apr. 9, 2003.

SUMMARY OF THE INVENTION

A propeller hub assembly, including a universal through-hub exhaust propeller hub having an overlap zone, custom driver adaptors and an optional removable exhaust ring and/or sized ventilation plugs, to facilitate use of conventional OEM (original equipment manufacturer) factory thrust washers used in conventional propeller hubs with corresponding driver adaptors in the universal propeller hub, in any marine outdrive application. Specifically, the propeller hub assembly of this invention is characterized by a propeller hub having a universal internal driver mount or receiver that defines an overlap zone which is a composite of a selected number of conventional OEM hub interior driver mounts or receivers. The propeller hub assembly further includes custom designed driver adaptors that seat in the universal driver mount and receive a corresponding OEM factory thrust washer in a conventional outdrive. Use of the conventional manufacturers' thrust washer in combination with a corresponding driver adaptor in the universal driver mount of the propeller hub greatly minimizes the danger of erroneously assembling non-OEM components on an outdrive assembly with a thrust washer that could damage the lower unit drive gears. The optional removable exhaust ring is designed to fit on the front edge of the propeller hub and may be provided with multiple openings which, in a preferred embodiment, may be custom punched in the periphery of the exhaust ring band to allow optimum exhaust porting relief according to the desired application. Furthermore, sized ventilation plugs may also be provided in the propeller hub at the base of the propeller blades, with or without the exhaust ring, and optional openings of selected size and number can be punched through the plugs, for the same purpose. Accordingly, the removable exhaust ring may be used in combination with the sized ventilation plugs or in mutually exclusive applications, including conventional propeller hub applications, depending upon the desired degree of exhaust porting required to optimize the outdrive performance in a variety of operating conditions.

DESCRIPTION OF THE DRAWINGS

The invention will be better understood by reference to the accompanying drawings, wherein.

DESCRIPTION OF THE PREFERRED EMBODIMENTS

Figure 9:
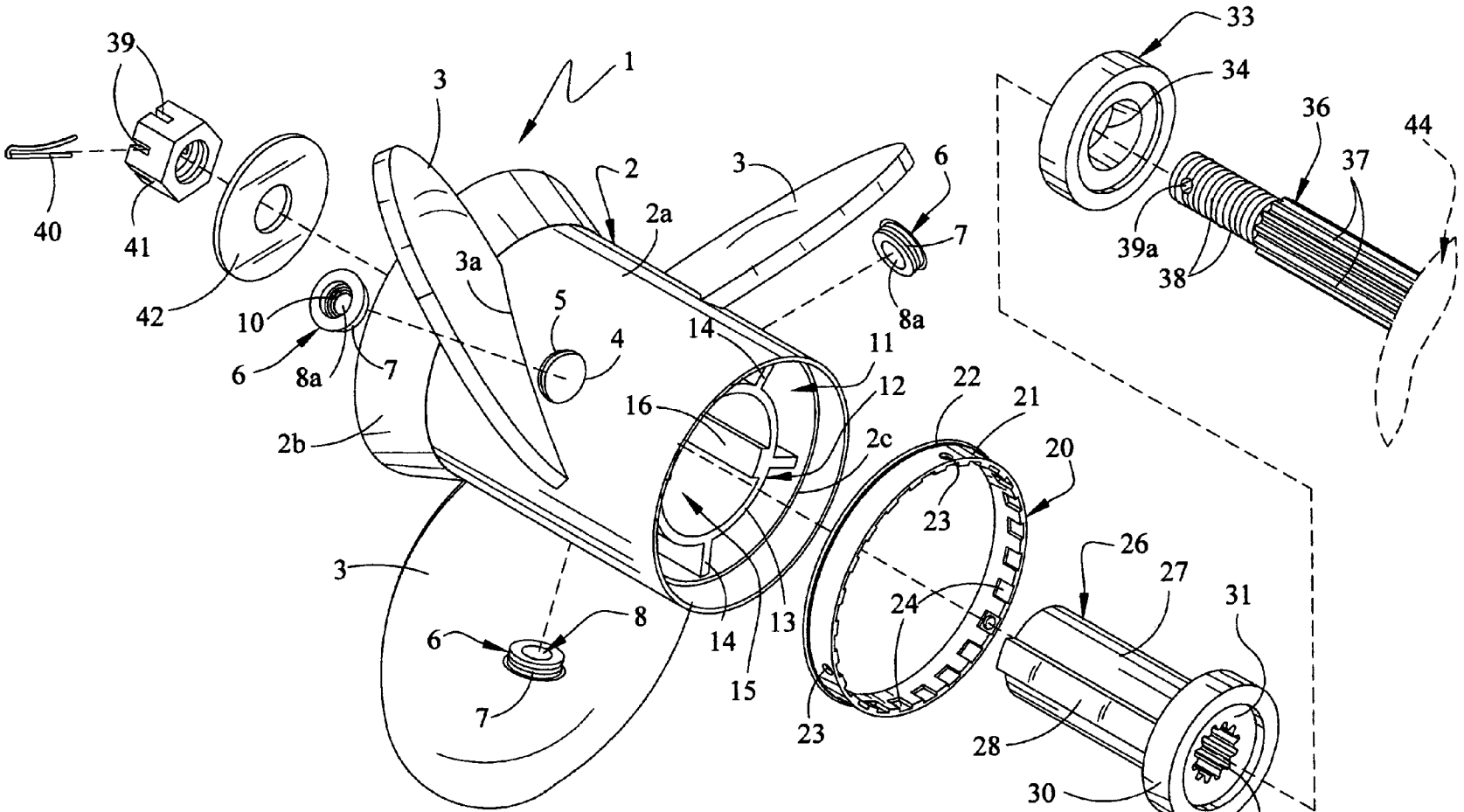
FIG. 9 is an exploded view of the propeller hub assembly illustrated in FIG. 1, more particularly illustrating the propeller hub fitted with a common or universal internal driver mount and more particularly illustrating an optional removable exhaust ring and typically plastic sealed ventilation plugs and the openings receiving those plugs, along with a typical custom driver adaptor for seating in the driver mount and accommodating a specific OEM factory thrust washer.

Referring initially to FIGS. 1, 2, 9 and 10 of the drawings in a preferred embodiment, the propeller hub assembly of this invention is generally illustrated by reference numeral 1 and includes a propeller hub 2, mounted on a motor lower unit 44 (illustrated in phantom in FIGS. 1 and 10) and characterized by a cylindrical hub barrel 2*a*, having a flared rear end 2*b*, with an exhaust ring groove 2*c* located in the inside surface of the front end of the hub barrel 2*a*, as illustrated in FIG. 9. The propeller hub 2 further includes three propeller blades 3, each extending from the hub barrel 2*a* of the propeller hub 2 at a blade base 3*a*. In a first preferred aspect of this embodiment of the invention a barrel plug opening 4 is provided in the hub barrel 2*a*, typically at the base of each of the propeller blades 3 (FIG. 9) and the barrel plug opening 4 is fitted with plug opening threads 5 to threadably receive a sealed ventilation plug 6 at each plug opening location. Each of the sealed ventilation plugs 6 includes plug threads 7 (FIG. 9) for threadably engaging the plug opening threads 5 in the barrel plug opening 4 and removably securing each sealed ventilation plug 6 in a corresponding barrel plug opening 4. Each sealed ventilation plug 6 further includes a plug exhaust opening 8, sealed by a plug base 8*a*, that may be varied in size, as hereinafter further described.

As further illustrated in FIGS. 1, 2, 7, 9 and 10 of the drawings an exhaust ring 20 is removably fitted on the forward end of the hub barrel 2*a* of the propeller hub 2 and includes a ring band 21 that may be constructed of a resilient material such as plastic or of a metal such as aluminum, in non-exclusive particular. The exhaust ring 20 includes an elastomeric band seal 22, such as an O-ring, on the forward end thereof, as illustrated. The elastomeric band seal 22 engages the internal exhaust ring groove 2*c* provided in the frontal inside surface of the hub barrel 2*a* (FIG. 9) to removably seat the exhaust ring 20 on the forward end of the propeller hub 2. As particularly illustrated in FIGS. 1 and 9 and as hereinafter further described, the exhaust ring 20 optionally includes one or more band ports 23 for porting exhaust gases flowing through the lower unit 44 and through the hub interior 11 of the hub barrel 2*a*. Furthermore, in a preferred aspect of this embodiment of the invention, the ring band 21 of the exhaust band 20 is characterized by spaced-apart, indented band seats 24 (FIG. 7), through selected ones of which the band ports 23 may extend. Accordingly, it will be appreciated from a consideration of FIGS. 7 and 9 of the drawings that a selected number of band ports 23 can be punched or otherwise provided in the band seats 24 of the exhaust ring 20 to facilitate a desired degree of porting or exhaust gas elimination from the hub interior 11, depending upon the desired application of the propeller hub assembly 1.

Figure 10:
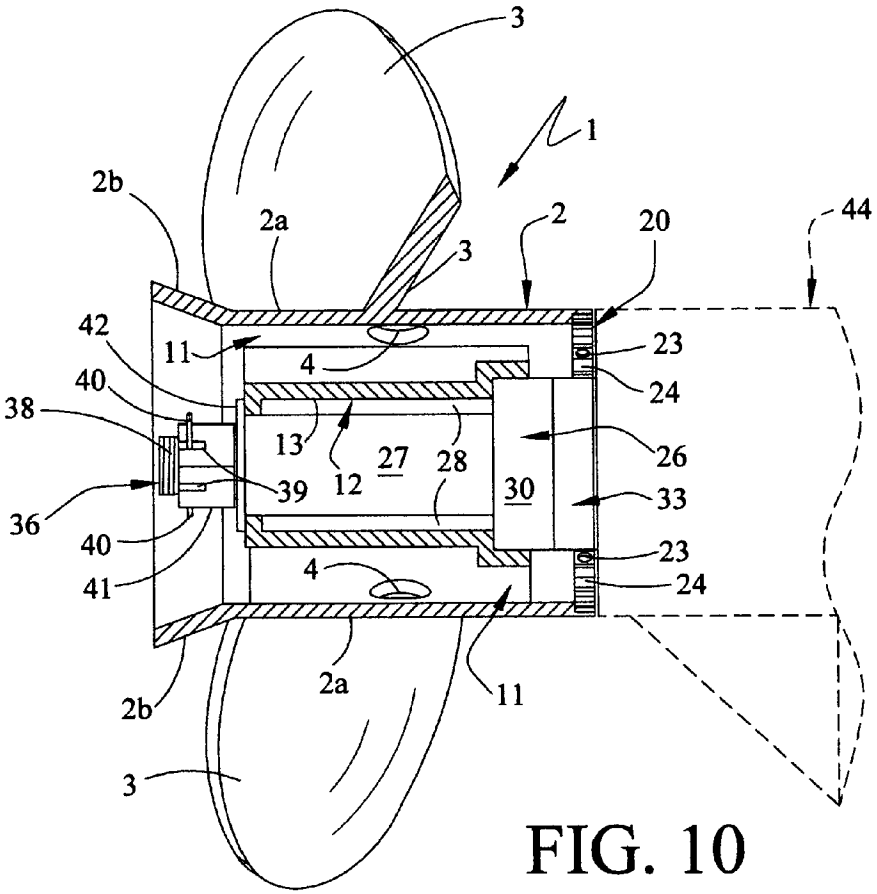
FIG. 10 is a side sectional view, taken along line 10—10 of the hub assembly illustrated in FIG. 1, more particularly illustrating assembly of the custom driver adaptor in the universal driver mount, with a castellated nut threaded on the drive shaft and a cotter pin in place to mount the propeller hub on a motor lower unit or outdrive.

Referring again to FIG. 9 and to FIGS. 10–15 of the drawings the propeller hub assembly 1 is characterized by a universal driver mount 12, located inside the hub interior 11 and including a cylindrical mount barrel 13 having radial mount barrel flanges 14 that extend to the inside surface of the hub barrel 2*a* in the hub interior 11 to fix the mount barrel 13 in the hub interior 11. A mount barrel bore 15 is defined by the mount barrel 13 and includes inwardly-projecting barrel engaging lugs 16, as further illustrated in FIGS. 9 and 11 of the drawings. The universal driver mount 12 in the hub barrel 2*a* defines a composite zone of common or composite dimension of selected conventional OEM propeller hub barrels or receivers, or an "overlap zone" 50 (FIGS. 12–15) for purposes which will be hereinafter discussed. A first driver adaptor 26 is characterized by a first driver adaptor barrel 27, fitted with outwardly-extending barrel lugs 28 and having internal barrel splines 29 with a barrel head 30 on one end and is designed to insert in the overlap zone 50 defined by the mount barrel bore 15 of the mount barrel 13 in the driver mount 12, as illustrated in FIGS. 9 and 10 of the drawings. The barrel head 30 of the first driver adaptor 26 is fitted with a barrel head recess 31 for receiving a corresponding conventional OEM factory thrust washer 33, as further illustrated in FIG. 11 of the drawings. The OEM factory thrust washer 33 includes a drive shaft opening 34 that receives a conventional drive shaft 36, extending from a motor lower unit 44 (FIG. 9) and having drive shaft splines 37 for engaging the internal barrel splines 29 in the first driver adaptor barrel 27 and also having drive shaft threads 38 and a cotter pin opening 39*a*, for receiving a conventional castellated nut 41, with cotter pin slots 39, and a cotter pin 40, respectively, when the propeller hub assembly 1 is assembled on the drive shaft 36, as illustrated in FIG. 10. A washer 42 is typically interposed between the castellated nut 41 and the shoulder of the drive shaft 36 at the end of the drive shaft threads 38 and the cotter pin 40 is typically extended through aligned cotter pin slots 39 in the castellated nut 41 and through the cotter pin opening 39*a* in the drive shaft 36, to secure the castellated nut 41 on the drive shaft threads 38 of the drive shaft 36, as further illustrated in FIGS. 9 and 10. In some cases an adaptor 43 (FIGS. 12–15) of suitable design is also necessary for fitting on the drive shaft 36 between the castellated nut 41 and the washer 42, to further accommodate the respective factory thrust washer 33 and custom driver adaptor in each application described herein.

Figure 1:
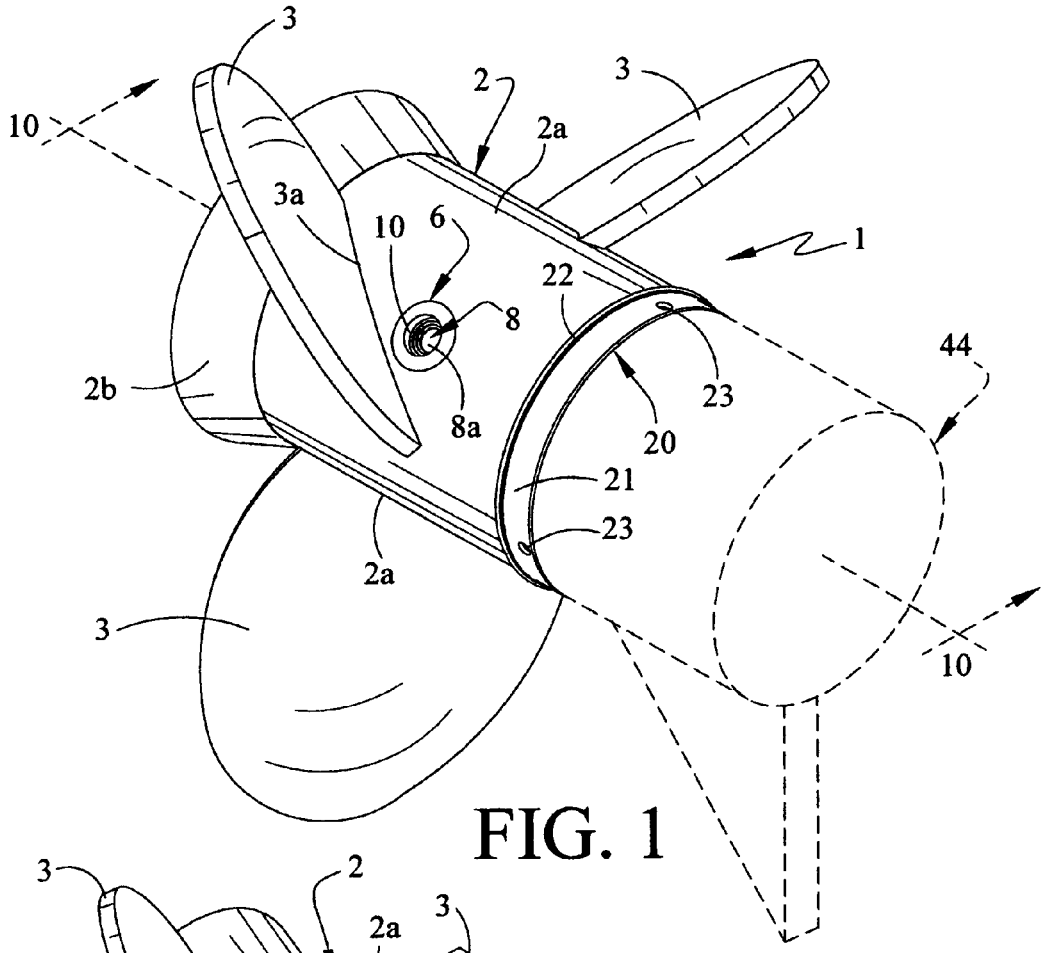
FIG. 1 is a perspective view of a preferred embodiment of the propeller hub assembly of this invention mounted on a motor outdrive or lower unit, more particularly illustrating application of an optional removable exhaust ring and sealed ventilation plug in the propeller hub.
Figure 2:
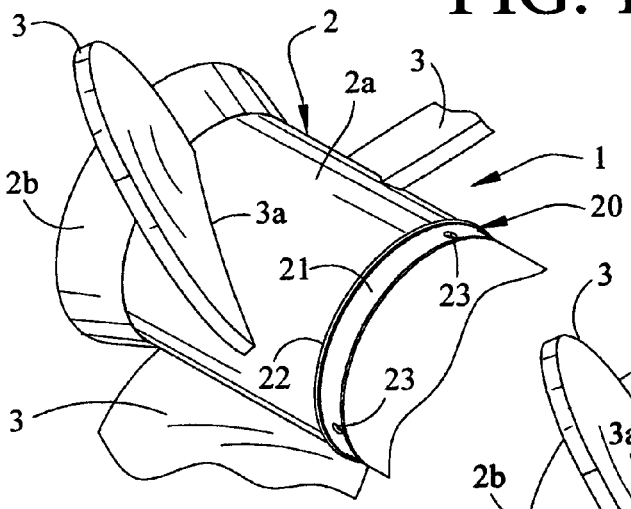
FIG. 2 is a perspective view, partially in section, of the propeller hub assembly illustrated in FIG. 1, more particularly illustrating application of a removable exhaust ring to a propeller hub having no sealed ventilation plug.
Figure 3:
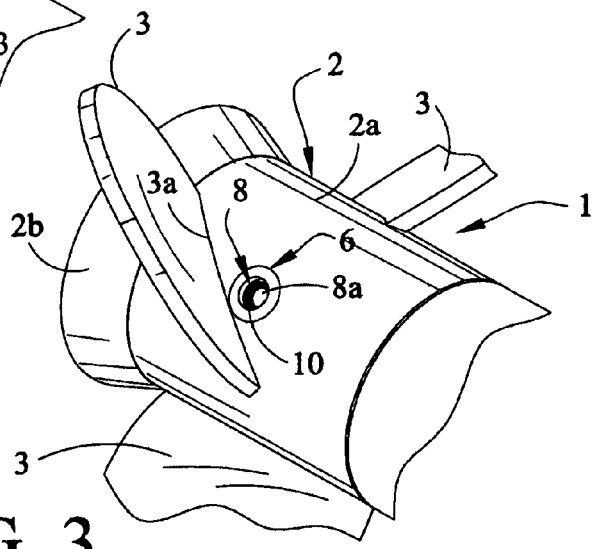
FIG. 3 is a perspective view of the propeller hub assembly illustrated in FIG. 1, more particularly illustrating provision of a removable sealed ventilation plug at the base of a propeller blade in a propeller hub having no exhaust ring.
Figure 4:
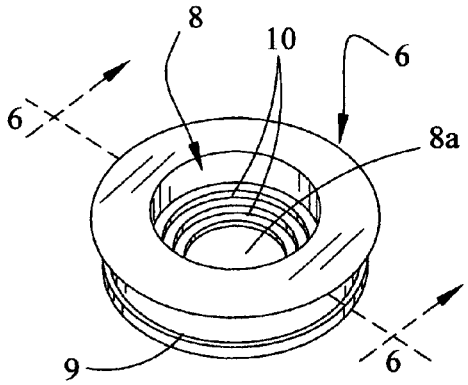
FIG. 4 is a perspective view of a first embodiment of the removable sealed ventilation plug illustrated in FIGS. 1 and 3.
Figure 5:
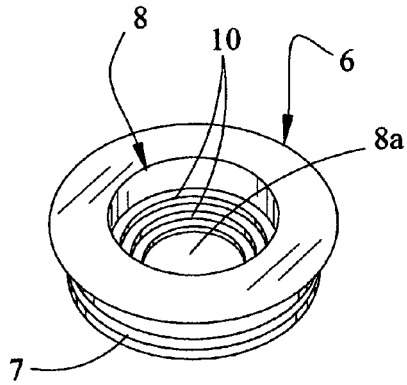
FIG. 5 is a perspective view of a second embodiment of the removable sealed ventilation plug illustrated in FIGS. 1 and 3.
Figure 6:
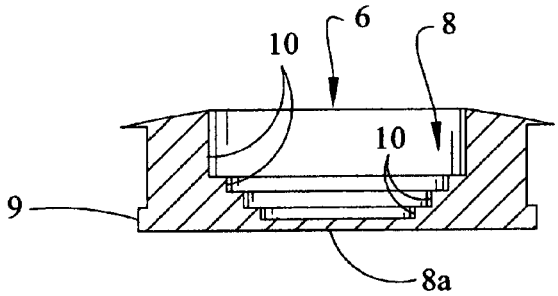
FIG. 6 is a sectional view, taken along line 6—6, of the removable sealed ventilation plug illustrated in FIG. 4.

Referring again to FIGS. 1, 3–6 and 9 of the drawings, under circumstances where it is desirable to use a sealed ventilation plug 6, typically located at the blade base 3*a* of each of the propeller blades 3 in the hub barrel 2*a*, each sealed ventilation plug 6 may be characterized in one embodiment by plug threads 7 that thread into corresponding plug opening threads 5 in each plug opening 4, as illustrated in FIGS. 5 and 9 of the drawings and as heretofore described. Alternatively, each sealed ventilation plug 6 may include an exterior plug seal 9, such as an elastomeric O-ring or the like, fitted in a corresponding groove (not illustrated) located in the extending bottom portion of the sealed ventilation plug 6 (FIG. 4) and the plug opening 4 provided in the hub barrel 2*a* may be fitted with a corresponding internal groove (not illustrated) for receiving the plug seal 9 and removably mounting each sealed ventilation plug 6 in a corresponding plug opening 4, as illustrated in FIGS. 1 and 3 of the drawings. As further illustrated in FIGS. 4–6, each sealed ventilation plug 6 is further characterized by a plug exhaust opening 8 that includes multiple step openings 10, extending in widening circles from a sealed plug base 8*a*, as illustrated in FIG. 6, to allow selective drilling or punching of the plug exhaust opening 8 through the sealed, plastic plug base 8*a*, typically while in the field. Accordingly, referring again to FIG. 6 of the drawings, the size of the plug exhaust opening 8 can be chosen by punching or drilling a selected one of the step openings 10 through the closed plug base 8*a*, to effect an opening through the sealed ventilation plug 6 that corresponds to the required degree of "porting" necessary to accommodate the flow of exhaust through the propeller hub 2 under operating conditions dictated by the design of the outboard motor and the motor outdrive or lower unit 44.

Figure 7:
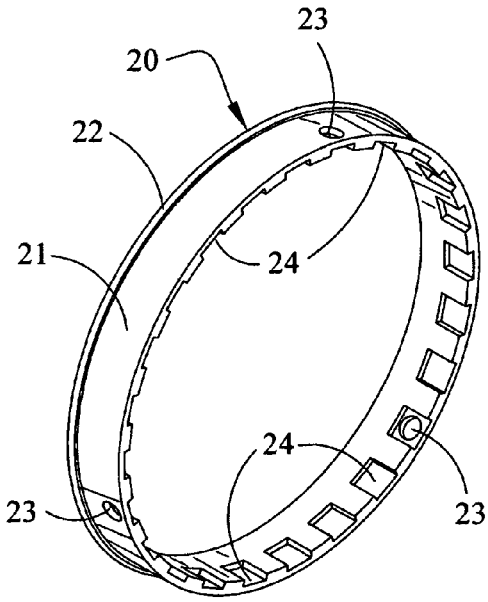
FIG. 7 is a perspective view of a first embodiment of the exhaust ring illustrated in FIGS. 1 and 2.
Figure 8:
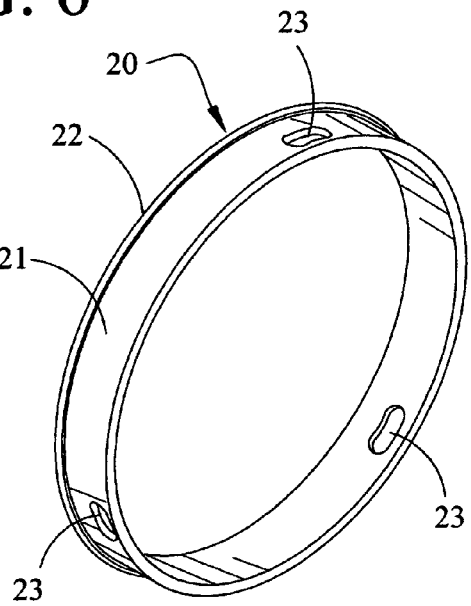
FIG. 8 is a perspective view of a second embodiment of the exhaust ring illustrated in FIGS. 1 and 2.

Referring now to FIGS. 1, 2 and 7–9 of the drawings under circumstances where it is desirable to use an exhaust ring 20 on the forward end of the hub barrel 2*a* of the propeller hub 2, an elastomeric, typically plastic or the like, exhaust ring 20 can be utilized as illustrated in FIGS. 7 and 9, typically with a desired number of band ports 23 provided in the indented band seats 24 of the elastomeric band seal 22, as heretofore described. In a preferred embodiment the band ports 23 are typically substantially equally spaced-apart around the periphery of the ring band 21 as illustrated in FIG. 7 and a desired number of band ports 23 can be provided, depending upon the degree of "porting", or exhaust gas relief deemed necessary to effect optimum operation of the hub assembly 1 for each application. As illustrated in FIG. 8 of the drawings, a metal such as aluminum can be used to shape the exhaust ring 20, which may optionally be provided with one or more band ports 23, typically disposed in spaced-apart relationship in the ring band 21. In a preferred embodiment of the invention these band ports 23 are elliptical and may be provided in varying size, spacing and number to facilitate "porting" of the exhaust flowing through the hub interior 11 of the hub barrel 2*a* in an optimum manner. In each case, the ring band 21 is fitted with a preferably elastomeric band seal 22 for engaging a corresponding, internally-positioned exhaust ring groove 2*c* in the frontal interior surface hub barrel 2*a*, as illustrated in FIG. 9 of the drawings. This removable mounting of the respective exhaust rings 20 allows removal and refitting, as desired. Furthermore, it will be appreciated from a consideration of FIG. 7 of the drawings that under circumstances where the ring band 21 is constructed of plastic or other resilient material, the corresponding band ports 23 can be created by a hole puncher inserted in selected ones of the band seats 24, as desired.

Figure 11:
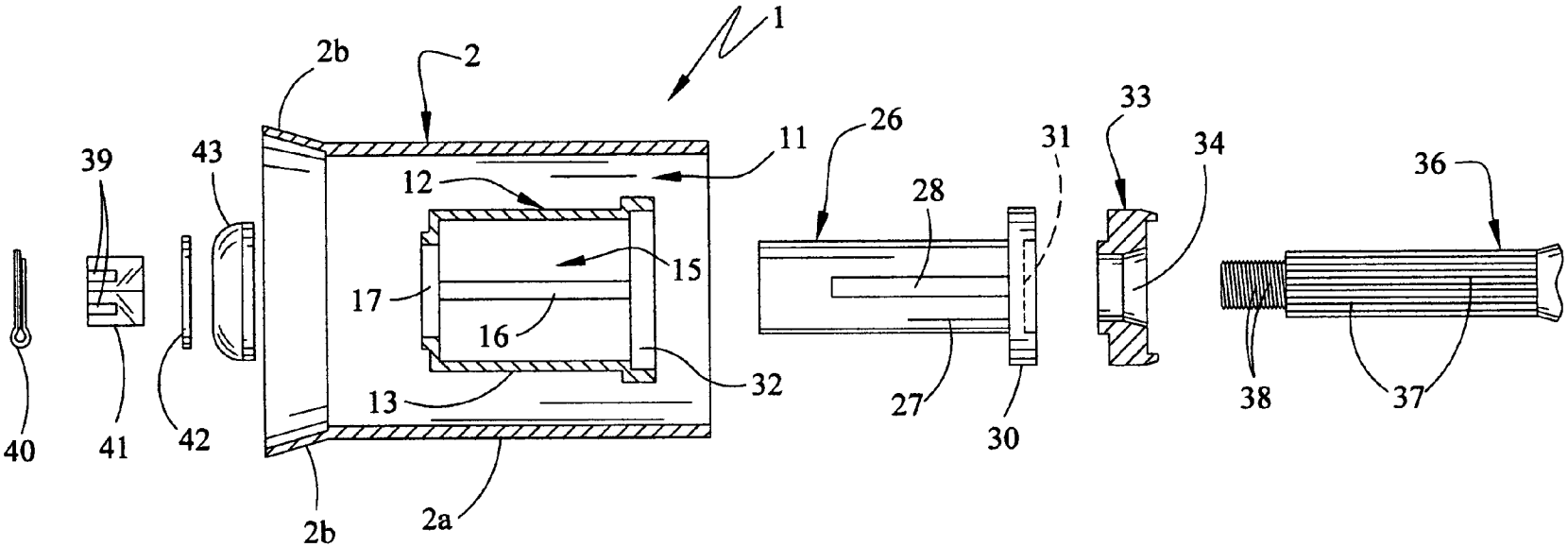
FIG. 11 is an exploded sectional view of the propeller hub assembly illustrated in FIG. 10, more particularly illustrating the relative position of an OEM factory thrust washer for seating against the barrel head of the corresponding custom driver adaptor when the driver adaptor is inserted in the universal driver mount as illustrated in FIG. 10.
Figure 12:
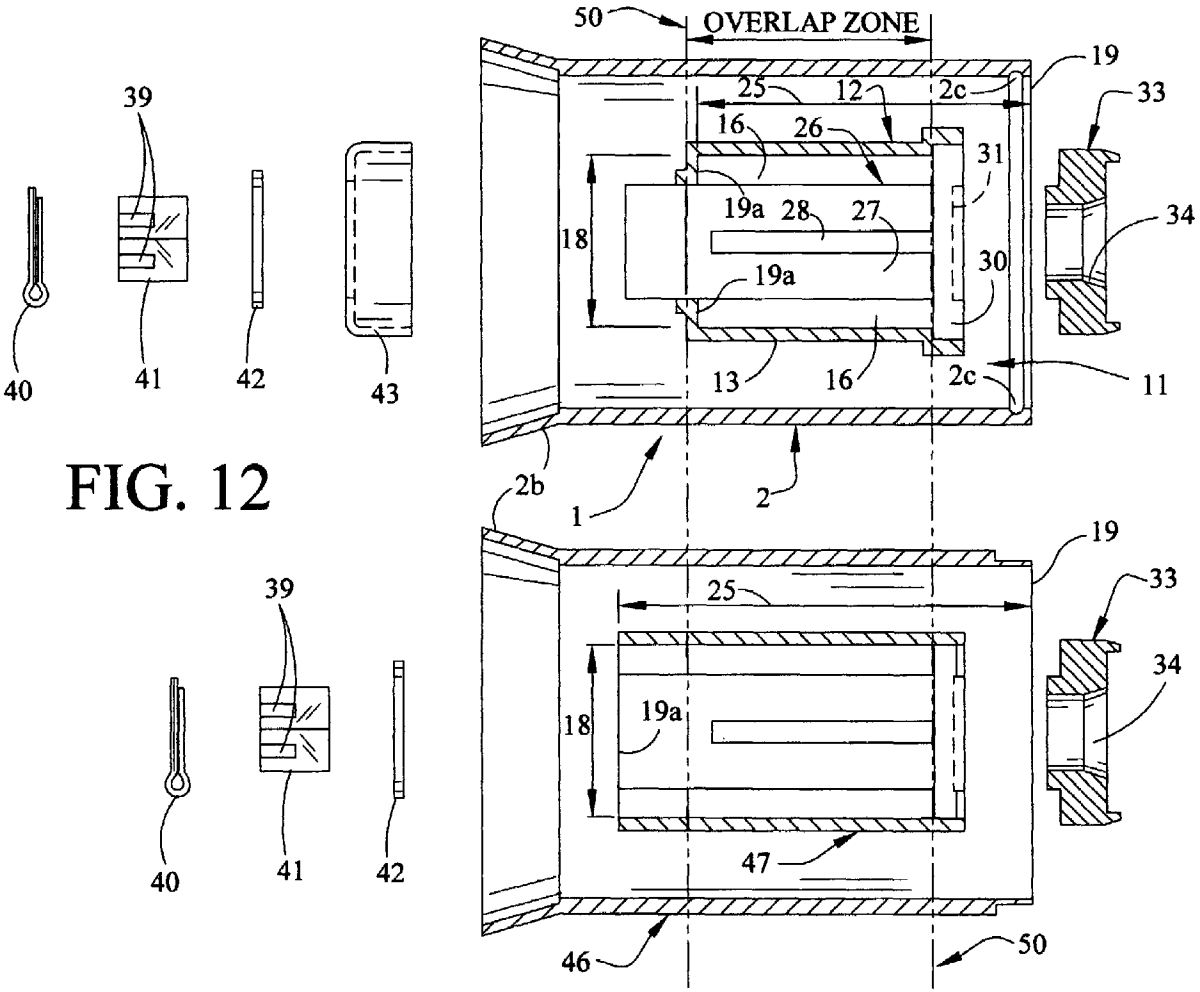
FIG. 12 is an exploded view of a first conventional hub assembly and corresponding OEM factory thrust washer, along with the propeller hub assembly of this invention utilizing the same OEM factory thrust washer and a specially designed first driver adaptor seated in a universal driver mount in the propeller hub, with an overlap zone composite illustrated in both hub assemblies.

Referring now to FIGS. 11 and 12 of the drawings a first conventional hub assembly 46 is illustrated in the lower part of FIG. 12 and includes a first conventional driver mount 47, that receives a driver (not illustrated) designed specifically for the first conventional driver mount 47. In the upper part of FIG. 12 and in FIG. 11, the propeller hub assembly 1 of this invention is illustrated, with the hub interior 11 of the propeller hub 2 internally receiving a common or universal driver mount 12 that is configured according to the overlap zone 50, which is a composite of the internal dimensions of the first conventional driver mount 47, as well as the internal dimensions of the second, third and fourth conventional driver mounts in the other conventional hub assemblies illustrated in FIGS. 13–15 of the drawings. Fitted in the driver mount 12 is a specially designed first driver adaptor 26, having a first driver adaptor barrel 27 extended inside the universal driver mount 12, through the overlap zone 50. The first driver adaptor barrel 27 is also fitted with outwardly-projecting barrel lugs 28 for engaging corresponding barrel engaging lugs 16, extending inwardly from the mount barrel 13 of the universal driver mount 12, as illustrated in FIGS. 9 and 11. This engagement facilitates driving of the propeller hub 2 by operation of the motor lower unit 44 and the drive shaft 36. Other driving components (not illustrated) may be provided inside the hub interior 11 and positioned between the corresponding barrel lugs 28 and barrel engaging lugs 16, as desired.

Figure 16:
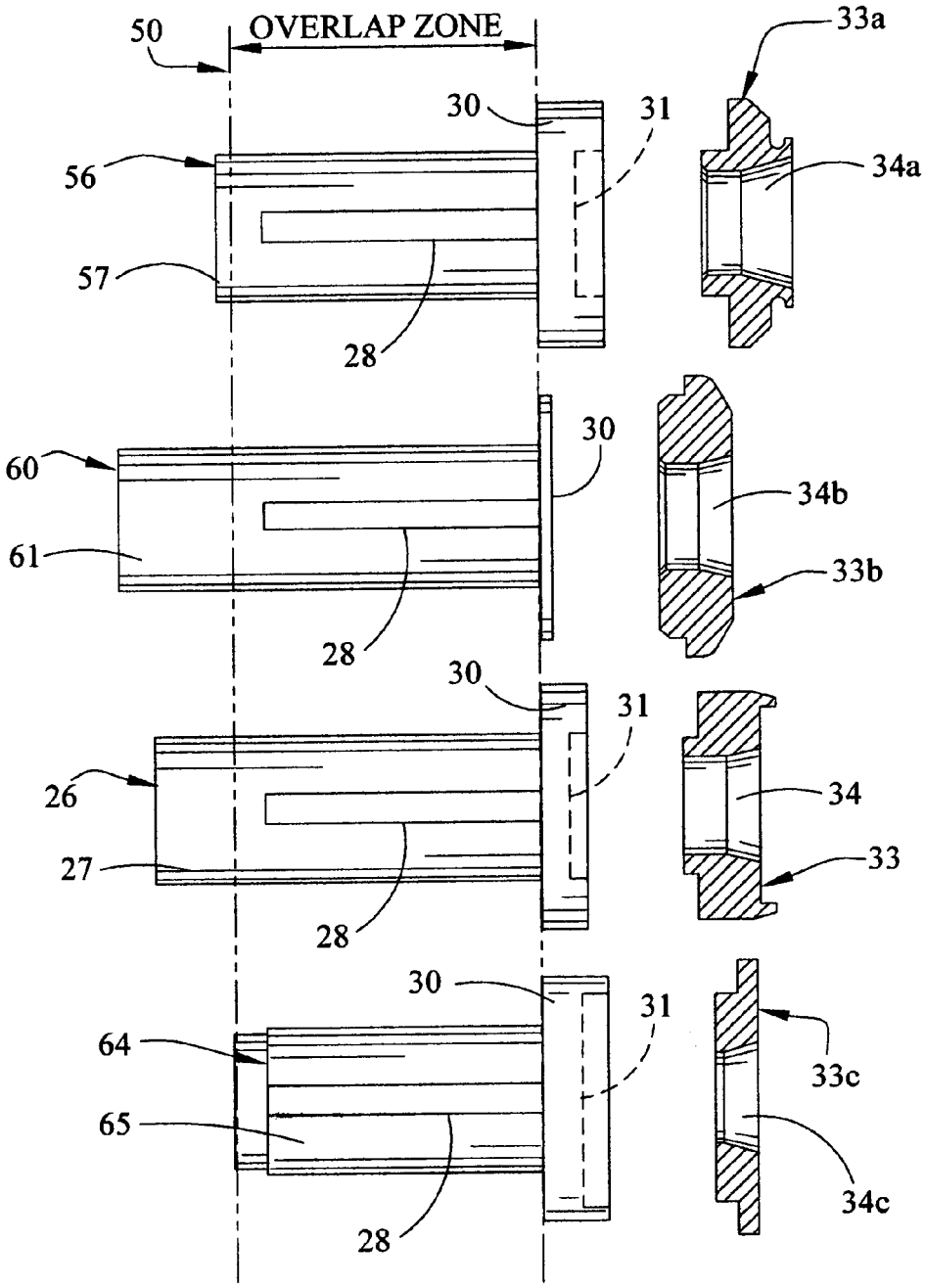
FIG. 16 is a side view of the respective first, second, third and fourth custom driver adaptors used with the corresponding OEM factory thrust washers in the universal propeller hub assembly illustrated in FIGS. 12–15.

As further illustrated in FIGS. 11, 12 and 16 of the drawings an OEM factory thrust washer 33, having a drive shaft opening 34, is used in the first conventional driver mount 47 of the first conventional hub assembly 46 and in the propeller hub assembly 1 located immediately above the first conventional hub assembly 46. The combination of the custom first driver adaptor 26, having a first driver adaptor barrel 27 inserted in the common or universal driver mount 12 in the propeller hub 2, with the adaptor 43, to compensate for the length of the first driver adaptor 26, is designed to facilitate use of this conventional OEM factory thrust washer 33 in the propeller hub assembly 1. Such use insures protection of the gears and other critical operating components (not illustrated) in the motor lower unit 44 when the propeller hub assembly 1 is characterized by various numbers of propeller blades 3 having various size, pitch and design and used in any factory or OEM motor lower unit 44.

Figure 13:
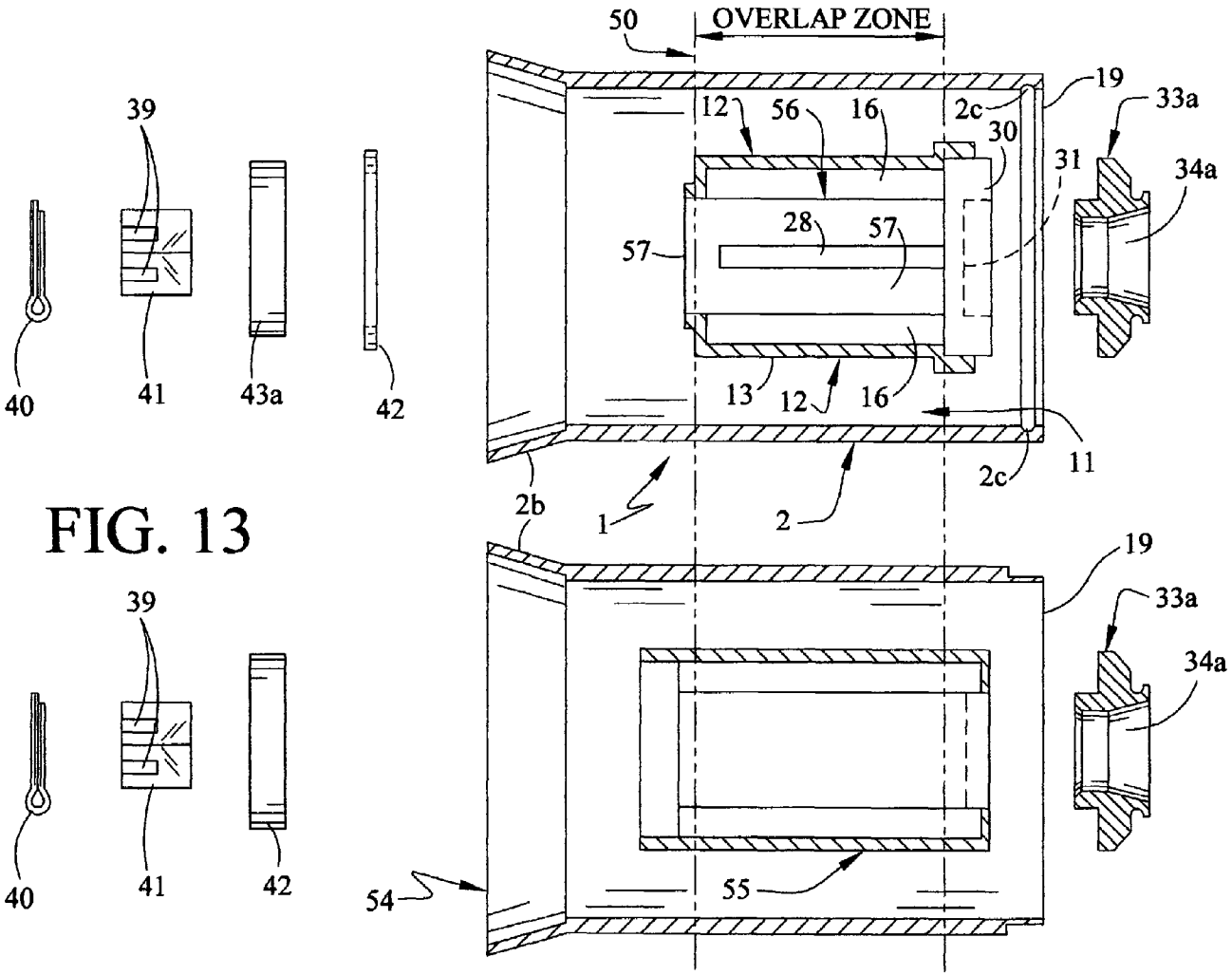
FIG. 13 is an exploded view of a second conventional hub assembly and corresponding OEM factory thrust washer, along with the propeller hub assembly of this invention utilizing the same OEM factory thrust washer and a specially designed second driver adaptor seated in the universal driver mount with the overlap zone composite illustrated in both hub assemblies.

Referring now to FIGS. 13 and 16 of the drawings a second conventional hub assembly 54 is illustrated in the lower part of FIG. 13 and the propeller hub assembly 1 of this invention is illustrated above the second conventional hub assembly 54. As in the case of the first conventional hub assembly 46 illustrated in FIG. 12, the second conventional hub assembly 54 is provided with a second conventional driver mount 55, which differs from the first conventional driver mount 47 in the first conventional hub assembly 46 and utilizes a different OEM factory thrust washer 33*a*, as illustrated. This OEM factory thrust washer 33*a*, having a drive shaft opening 34*a*, is also utilized in the propeller hub assembly 1 illustrated above the second conventional hub assembly 54, in connection with a second driver adaptor 56, designed to seat in the universal driver mount 12. The second driver adaptor 56 has a second driver adaptor barrel 57, fitted with barrel lugs 28 that extend into the universal driver mount 12, through the overlap zone 50. As described above, the overlap zone 50 composite dimension includes the internal dimensions of the second conventional driver mount 55 in the second conventional hub assembly 54, as further illustrated in FIG. 13. Accordingly, by using the specially designed second driver adaptor 56 in the corresponding common or universal driver mount 12 of the propeller hub assembly 1 of this invention and an adaptor 43*a* of selected dimension, the conventional OEM factory thrust washer 33*a* can be utilized and may be seated in the barrel head recess 31 of the corresponding barrel head 30 of the second driver adaptor 56.

Figure 14:
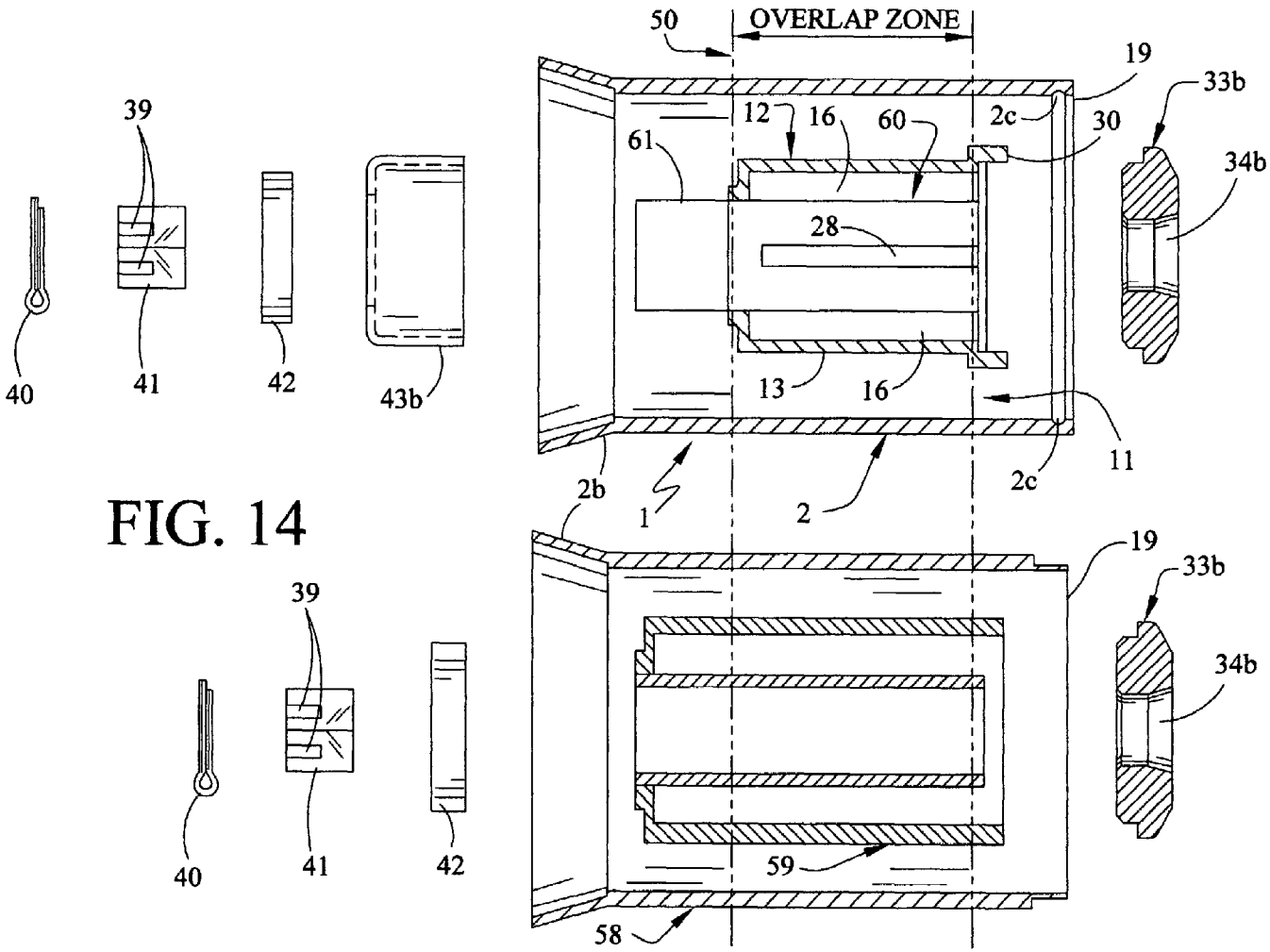
FIG. 14 is an exploded view of a third conventional hub assembly and corresponding OEM factory thrust washer, along with the propeller hub assembly of this invention utilizing the OEM factory thrust washer and a specially designed third driver adaptor seated in the driver mount with the overlap zone composite illustrated in both hub assemblies.

Referring now to FIG. 14 of the drawings a third conventional hub assembly 58 is illustrated, having a third conventional driver assembly 59 provided therein, which differs from both the first conventional driver mount 47 and the second conventional driver mount 55. An OEM factory thrust washer 33*b*, having a drive shaft opening 34*b*, is different in configuration from the OEM factory thrust washers 33 and 33*a* illustrated in FIGS. 12 and 13, respectively, and is provided for use with the third conventional hub assembly 58. A third driver adaptor 60 has a third driver adaptor barrel 61, fitted with barrel lugs 28 and is specially designed to accommodate the OEM factory thrust washer 33*b* in the universal driver mount 12 of the propeller hub assembly 1. Furthermore, a spacer 43*b* is used in connection with the washer 42 to compensate for the length of the third driver adaptor 60, accommodate the factory thrust washer 33*b* and properly secure the drive shaft 36 (illustrated in FIG. 9) in the propeller hub assembly 1 by means of the castellated nut 41 and cotter pin 40.

Figure 15:
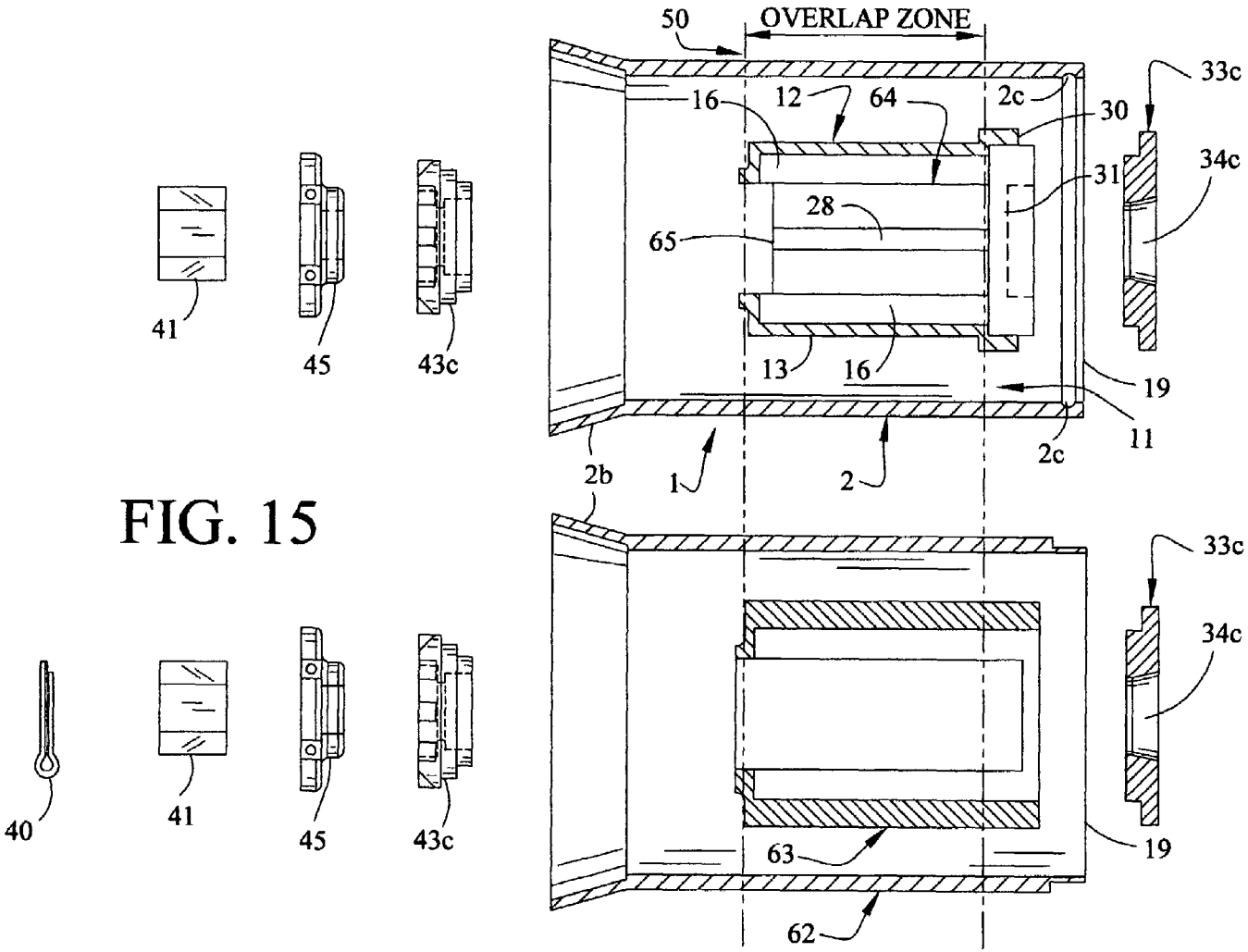
FIG. 15 is an exploded view of a fourth conventional hub assembly and corresponding OEM factory thrust washer, along with the propeller hub assembly of this invention utilizing the same OEM factory thrust washer and a specially designed fourth driver adaptor seated in the driver mount with the overlap zone composite illustrated in both hub assemblies.

Referring to FIG. 15 of the drawings a fourth conventional hub assembly 62 is illustrated in the bottom of the drawing, with the propeller hub assembly 1 positioned above the fourth conventional hub assembly 62. The fourth conventional hub assembly 62 is further provided with a fourth conventional driver mount 63, designed to accommodate a driver (not illustrated) specific to the fourth conventional hub assembly 62, when using an OEM factory thrust washer 33*c*, having a drive shaft opening 34*c*, as illustrated. The same OEM factory thrust washer 33*c* is used in the propeller hub assembly 1 in connection with a fourth driver adaptor 64, having a fourth driver adaptor barrel 65, inserted in the universal driver mount 12 of the propeller hub assembly 1, as illustrated in FIG. 15. Accordingly, the propeller hub assembly 1 is designed to receive the fourth driver adaptor 64 in the universal driver mount 12 of the propeller hub 2 using the cooperating adaptor 43*c* and lock tab 45 and has a barrel head recess 31 in the barrel head 30 thereof for receiving a stepped portion of the OEM factory thrust washer 33*c*.

It will be appreciated from a consideration of FIGS. 10–16 and especially FIGS. 12–15 of the drawings that the first conventional hub assembly 46, second conventional hub assembly 54, third conventional hub assembly 58 and fourth conventional hub assembly 62 are positioned in stacked configuration, each below a common or universal propeller hub assembly 1 in each drawing, to illustrate determination of the overlap zone 50, which defines the universal driver mount 12. Accordingly, the overlap zone 50 is determined by initially determining the largest inner hub diameter 18 (FIG. 12) of a selected family of propeller hubs, typically the propeller hubs in the first conventional hub assembly 46 (FIG. 12), the second conventional hub assembly 54, the third conventional hub assembly 58 and the fourth conventional hub assembly 62, in non-exclusive particular. When this largest inner hub diameter 18 is determined, the deepest inset dimension measured from the forward end 19 of each conventional propeller hub to the base or bottom of the thickest OEM factory thrust washer 33, 33*a*, 33*b* and 33*c*, is determined, to facilitate location of the closest one of the parallel lines to the forward end 19 of the propeller hub, as illustrated in FIGS. 12–15 of the drawings. The remaining parallel line defining the opposite end of the overlap zone 50 is determined by locating the shortest hub distance 25 from the forward end 19 of the conventional propeller hub in each case, to the aft end 19*a* of the internal hub cavity. These measurements determine the parallel lines that define the overlap zone 50, illustrated in FIGS. 12–15. Accordingly, the design of the driver mount 12 in terms of diameter and length is set by the overlap zone 50, as illustrated in FIGS. 12–16. When these dimensions have been determined and the overlap zone 50 is overlaid as indicated in FIGS. 12–16, the first driver adaptor 26, second driver adaptor 56, third driver adaptor 60 and fourth driver adaptor 64 can be designed and coordinated with each corresponding OEM factory thrust washer 33, 33*a*, 33*b* and 33*c* in mind and using a corresponding adaptor or adaptors 43, 43*a*, 43*b* and 43*c*, respectively, to fit the respective driver adaptors in the common, universal driver mount 12 in the propeller hub 2 of the propeller hub assembly 1 of this invention. The common universal driver mount 12 and respective driver adaptors thus accommodates the respective corresponding factory thrust washers 33, 33*a*, 33*b* and 33*c*, as illustrated in the top area of FIGS. 12–15 and in FIG. 16. Seating of the OEM factory thrust washers 33, 33*a* and 33*c* in the corresponding barrel head recess 31 of the barrel head 30 of the respective first driver adaptor 26, second driver adaptor 56 and fourth driver adaptor 64 and the OEM factory thrust washer 33*b* on the barrel head 30 of the third driver adaptor 60, is illustrated with regard to the first driver adaptor 26 and the OEM factory thrust washer 33 in FIGS. 10 and 11 of the drawings.

Accordingly, it will be appreciated that for each family of outboard motors or outdrives using a motor lower unit 44 as illustrated in FIG. 1 of the drawings, a common or universal driver mount 12 can be provided inside the hub barrel 2*a* of a propeller hub 2, utilizing the overlap zone 50 to accommodate a specially designed first driver adaptor 26, second driver adaptor 56, third driver adaptor 60 and fourth driver adaptor 64, along with the corresponding factory supplied, OEM factory thrust washers 33, 33*a*, 33*b* and 33*c* and companion adaptors 43, 43*a*, 43*b* and 43*c*, respectively. This facility insures that the proper thrust washer is always provided on the forward end of the propeller hub assembly 1 to prevent damage to the gears and other operating parts (not illustrated) in the motor lower unit 44, under circumstances where it is desired to use different propellers on any given conventional motor lower unit 44.

As described above, in some cases, for example, as illustrated in FIGS. 12–15 of the drawings, an adaptor 43, 43*a*, 43*b* and 43*c*, respectively, of specific design for the particular motor lower unit 44 under consideration must be added, in order to provide the proper spacing on the drive shaft 36, as the drive shaft 36 is extended through the respective OEM factory thrust washers 33*a*, 33*b* and 33*c*, the second driver adaptor barrel 57, the third driver adaptor barrel 61 or the fourth driver adaptor barrel 65, and through the universal driver mount 12 to receive an adaptor 43, along with the washer 42 and the castellated nut 41.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed:

1. A propeller hub assembly for mounting on an outdrive comprising a propeller hub having an overlap zone and a drive adaptor connected to the outdrive and seated in said propeller hub and extending into said overlap zone and driving said propeller hub responsive to operation of the outdrive and at least one ventilation plug provided in said propeller hub and at least one step seal provided in said ventilation plug for selectively venting exhaust gas from said propeller hub responsive to removal of said at least one step seal.

2. The propeller hub assembly of claim 1 wherein said at least one step seal comprises a plurality of step seals of varying diameter.

3. The propeller hub assembly of claim 2 comprising hub threads provided in said propeller hub and plug threads provided on said ventilation plug, said plug threads engaging said hub threads and removably securing said ventilation plug in said propeller hub.

4. The propeller hub assembly of claim 2 comprising a groove provided on said propeller hub and a plug seal provided on said ventilation plug, said plug seal removably engaging said groove and removably securing said ventilation plug in said propeller hub.

5. The propeller hub assembly of claim 1 comprising a removable exhaust ring provided on said propeller hub; a plurality of band seats provided in said exhaust ring; and at least one exhaust ring port provided in said band seats for venting exhaust gas from said propeller hub.

6. The propeller hub assembly of claim 5 comprising at least one ventilation plug provided in said propeller hub and at least one step seal provided in said ventilation plug for selectively venting exhaust gas from said propeller hub responsive to removal of said at least one step seal.

7. The propeller hub assembly of claim 6 wherein said at least one step seal comprises three step seals.

8. The propeller hub assembly of claim 7 comprising hub threads provided in said propeller hub and plug threads provided on said ventilation plug, said plug threads engaging said hub threads and removably securing said ventilation plug in said propeller hub.

9. The propeller hub assembly of claim 7 comprising a groove provided on said propeller hub and a plug seal provided on said ventilation plug, said plug seal removably engaging said groove and removably securing said ventilation plug in said propeller hub.

10. A propeller hub assembly for mounting on the outdrive of an engine and using an OEM factory thrust washer, said propeller hub assembly comprising a propeller hub; a driver mount provided in said propeller hub, said driver mount defining an overlap zone in said propeller hub; a driver adaptor connected to the outdrive, said driver adaptor inserted in said driver mount and said driver adaptor compatible with the OEM factory thrust washer, wherein said propeller hub is driven responsive to rotation of said driver adaptor by operation of the outdrive; and a removable exhaust ring provided on said propeller hub; a plurality of band seats provided in said exhaust ring; and at least one exhaust ring port provided in said band seats for venting exhaust gas from said propeller hub.

11. The propeller hub assembly of claim 10 comprising at least one ventilation plug provided in said propeller hub and at least one step seal provided in said ventilation plug for selectively venting exhaust gas from said propeller hub responsive to removal of said at least one step seal.

12. The propeller hub assembly of claim 11 comprising hub threads provided in said propeller hub and plug threads provided on said ventilation plug, said plug threads engaging said hub threads and removably securing said ventilation plug in said propeller hub.

13. The propeller hub assembly of claim 11 comprising a groove provided on said propeller hub and a plug seal provided on said ventilation plug, said plug seal removably engaging said groove and removably securing said ventilation plug in said propeller hub.

14. The propeller hub assembly of claim 11 wherein said at least one step seal comprises a plurality of step seals of varying diameter.

15. The propeller of claim 14 comprising hub threads provided in said propeller hub and plug threads provided on said ventilation plug, said plug threads engaging said hub threads and removably securing said ventilation plug in said propeller hub.

16. The propeller of claim 14 comprising a groove provided on said propeller hub and a plug seal provided on said ventilation plug, said plug seal removably engaging said groove and removably securing said ventilation plug in said propeller hub.

17. A propeller hub assembly for mounting on the outdrive of an engine comprising a propeller hub; a drive adaptor connected to the outdrive and seated in said propeller hub for driving said propeller hub responsive to operation of the outdrive; a ventilation plug provided in said propeller hub and a plurality of step seals of varying diameter provided in said ventilation plug for selectively venting exhaust gas from said propeller hub responsive to selective removal of said step seals.

18. The propeller hub assembly of claim 17 comprising hub threads provided in said propeller hub and plug threads provided on said ventilation plug, said plug threads engaging said hub threads and removably securing said ventilation plug in said propeller hub.

19. The propeller hub assembly of claim 17 comprising a groove provided on said propeller hub and a plug seal provided on said ventilation plug, said plug seal removably engaging said groove and removably securing said ventilation plug in said propeller hub.

20. The propeller hub assembly of claim 17 comprising a removably exhaust ring provided on said propeller hub; a plurality of band seats provided in said exhaust ring; and at least one exhaust ring port provided in said band seats for venting exhaust gas from said propeller hub.

21. A propeller hub assembly for mounting on the outdrive of an engine comprising a propeller hub, a drive adaptor connected to the outdrive and seated in said propeller hub for driving said propeller hub responsive to operation of the outdrive; a removable exhaust ring provided on said propeller hub; a plurality of band seats provided on said exhaust ring and a plurality of exhaust ring ports provided in selected ones of said band seats for venting exhaust gas from said propeller hub.

22. The propeller hub assembly of claim 21 comprising at least one ventilation plug provided in said propeller hub and at least one step seal provided in said ventilation plug for selectively venting exhaust gas from said propeller hub responsive to removal of said at least one step seal.

23. The propeller hub assembly of claim 22 wherein said at least one step seal comprises three step seals of varying diameter.

24. The propeller hub assembly of claim 22 comprising hub threads provided in said propeller hub and plug threads provided on said ventilation plug, said plug threads engaging said hub threads and removably securing said ventilation plug in said propeller hub.

25. The propeller hub assembly of claim 22 comprising a groove provided on said propeller hub and a plug seal provided on said ventilation plug, said plug seal removably engaging said groove and removably securing said ventilation plug in said propeller hub.

* * * * *